United States Patent [19]

Wakino et al.

[11] 4,028,652

[45] June 7, 1977

[54] DIELECTRIC RESONATOR AND MICROWAVE FILTER USING THE SAME

[75] Inventors: Kikuo Wakino, Muko; Toshio Nishikawa, Nagaokakyo; Sadahiro Tamura; Youhei Ishikawa, both of Kyoto, all of Japan

[73] Assignee: Murata Manufacturing Co., Ltd., Kyoto, Japan

[22] Filed: Sept. 5, 1975

[21] Appl. No.: 610,780

[30] Foreign Application Priority Data

| | | |
|---|---|---|
| Sept. 6, 1974 | Japan | 49-107909[U] |
| Oct. 12, 1974 | Japan | 49-123304[U] |
| Jan. 22, 1975 | Japan | 50-10752[U] |
| Jan. 27, 1975 | Japan | 50-12555[U] |
| Jan. 27, 1975 | Japan | 50-12556[U] |
| July 4, 1975 | Japan | 50-93990[U] |

[52] U.S. Cl. ..... 333/73 W; 333/83 R; 333/83 A

[51] Int. Cl.² ..... H01P 7/06; H01P 1/16; H01P 1/20; H01P 3/16

[58] Field of Search ..... 333/73 W, 83 R, 73 R, 333/83 A, 98 R

[56] References Cited

UNITED STATES PATENTS

| | | | |
|---|---|---|---|
| 2,838,736 | 6/1958 | Foster | 333/83 R |
| 3,696,314 | 10/1972 | Kell et al. | 333/73 W |
| 3,798,578 | 3/1974 | Konishi et al. | 333/83 T |
| 3,821,669 | 6/1974 | Wuerffel | 333/83 R |
| 3,913,039 | 10/1975 | Weiner | 333/73 R |

*Primary Examiner*—Alfred E. Smith
*Assistant Examiner*—Marvin Nussbaum
*Attorney, Agent, or Firm*—Birch, Stewart, Kolasch and Birch

[57] ABSTRACT

There is disclosed a dielectric resonator which comprises a block of any desired shape prepared from any known dielectric material. The dielectric block has one or more apertures. The aperture in the dielectric block may be in the form of a through-hole or a cavity or blind-hole. In the case of employment of a pluraity of apertures in the dielectric block, they may be of the same size or of different size and of the same type of aperture or of different types of aperture. Various types of microwave filters using one or more dielectric resonators referred to above are also disclosed.

9 Claims, 36 Drawing Figures

DIELECTRIC RESONATOR AND MICROWAVE FILTER USING THE SAME

The present invention relates to a dielectric resonator and, more particularly, to a dielectric resonator advantageously usable in a microwave filter with substantial improved reduction in the spurious response.

It is well known that a microwave band-pass filter utilizes one or more resonators made of dielectric material. In the conventionally practised manufacture of the dielectric resonator filter, reduction of undesirable spurious responses is carried out by making a relatively great difference between the resonance frequency of high mode and that of fundamental or dominant mode. In order to achieve this, various methods have heretofore been employed and, of them, one method is to appropriately select the ratio between the diameter and height of the resonator employed. Another method is to reduce, by any means, the value of Q at the high mode of resonance frequencies so that the undesirable spurious responses can be reduced.

However, it has been found that the first mentioned method is merely successful in making the ratio of the resonance frequency at the fundamental or dominant mode relative to the resonance frequency at the high mode approximating to the dominant mode to about 1.3 which is not satisfactory in respect of the reduction in the spurious response characteristic. On the other hand, it has also been found that the second mentioned method cannot be carried out only with difficulty because it is difficult to reduce only the value of Q at the high mode without an accompanying reduction of the value of Q at the dominant mode.

Moreover, during the manufacture of the conventional dielectric resonator filter, the dielectric resonator or resonators are housed within a shielded metal case and mounted on one interior surface of the metal case through a dielectric or electrically insulating spacer or spacers rigidly secured to said one interior surface. In this case, the dielectric resonators are secured to the corresponding spacers by the use of an adhesive or bonding material. Where the adhesive material is employed to connect the individual resonators to the corresponding spacers within the metal case, respective surfaces of the resonators and corresponding spacers must be cleaned prior to application of the adhesive material and/or the type of adhesive material to be employed must carefully be selected, or otherwise improvement as to the shock resistance of the filter cannot be made. In this way, the manufacture of the conventional resonator filter is very complicated.

Accordingly, an essential object of the present invention is to provide an improved dielectric resonator which, when used in a microwave filter, is capable of giving a relatively great difference between the high mode resonance frequency, and the dominant mode resonance frequency thereby substantially remarkably reducing the undesirable spurious responses.

It is a related important object of the present invention to provide a microwave filter utilizing one or more dielectric resonators referred to above, wherein the degree of resonator coupling can be adjustable as desired.

In order to accomplish these objects of the present invention the present invention is featured by the fact that the resonator comprises a block of known dielectric material having one or more apertures formed therein. The dielectric block may have an outer appearance of any desired shape such as a cylindrical shape or a cubic shape. The aperture formed in the dielectric block may either extend completely through the thickness of the dielectric block or terminate substantially halfway across the thickness of the dielectric block and, therefore, includes a through-hole, a blind hole or a cavity of any desired sectional shape such as a circular shape or a polygonal shape. The shape of the dielectric block and the shape and type of the aperture may be selected in any desired combination. In addition, where two or more apertures are employed in the single dielectric block, respective shapes and types of the apertures may be either identical with each other or different from each other. Furthermore, the aperture may not only be formed in alignment with the center line passing through the center of the dielectric block or the longitudinal axis of the dielectric block, but also be formed in offset relation to said center line or said longitudinal axis of said dielectric block.

Because of the provision of the aperture or apertures in the dielectric block forming the resonator according to the present invention, undesirable spurious frequencies can greatly be separated from resonance frequencies at the dominant mode as compared with the known dielectric block without the aperture formed therein.

BRIEF DESCRIPTION OF THE DRAWINGS

These and other objects and features of the present invention will become apparent from the following description made in conjunction with preferred embodiments thereof with reference to the accompanying drawings, in which.

Before the description of the present invention proceeds, it should be noted that like parts are designated by like reference numerals throughout the accompanying drawings.

Figure 1:
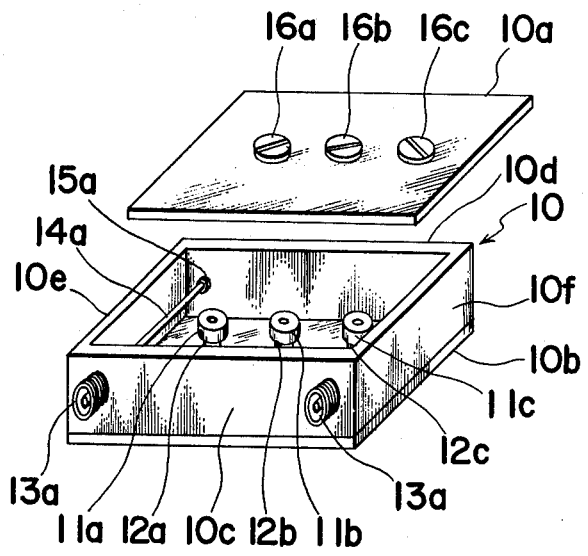
FIG. 1 is a perspective view of a microwave filter according to a first preferred embodiment of the present invention, which is shown with a top cover separated from a metal casing to show an arrangement of dielectric resonators.
Figure 2:
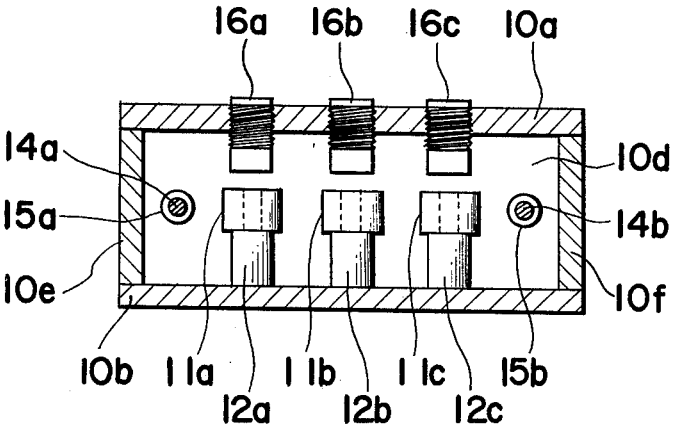
FIG. 2 is a cross sectional view, on a somewhat enlarged scale, of the microwave filter shown in FIG. 1.

Referring first to FIGS. 1 and 2, a microwave bandpass filter shown comprises a substantially box-like casing 10, made of any known metallic material such as brass, which casing 10 includes top and bottom coverings 10*a* and 10*b*, a pair of opposed side walls 10*c* and 10*d* and a pair of end walls 10*e* and 10*f*. Although the walls 10*c* to 10*f* are shown as integrally formed while the top and bottom coverings 10*a* and 10*b* are adapted to be secured to top and bottom edges of these walls 10*c* to 10*f*, respectively, by the use of, for example, a plurality of set screws (not shown), the walls 10*c* to 10*f* and the bottom covering 10*b* may be integrally formed together by excavating, or otherwise recessing, a rigid metal block.

Within the casing 10, one or more resonators, which are shown in three in number and indicated by 11*a*, 11*b* and 11*c*, are mounted on the bottom covering 10*b* through respective supporting spacers 12*a*, 12*b* and 12*c* and arranged in spaced and side-by-side relation with respect to each other in a row, said supporting spacers 12*a* to 12*c* being made of any known electrically insulating material of relatively low dielectric constant. The details of each of the resonators 11*a* to 11*c* and a method of mounting the resonators 11*a* to 11*c* on the bottom covering 11*b* through the respective supporting spacers 12*a* to 12*c* will subsequently be described.

One of the opposed side walls 10*c* is provided at respective portions adjacent the opposed ends thereof with couplers 13*a* and 13*b* for respective connection with coaxial cables for microwave input and output transmission lines (not shown). These couplers 13*a* and 13*b* have axial terminals which are electrically insulated from the metal casing 10 and which are respectively connected with rods or probes 14*a* and 14*b* made of either electrically conductive material or dielectric material. The probes 14*a* and 14*b* in the instance as shown in FIGS. 1 and 2 extend in parallel relation to any of the end walls 10*e* and 10*f*, and respectively between the end wall 10*e* and the end resonator 11*a* and between the end wall 10*f* and the end resonator 11*c*. One of the opposed ends of each of the probes 14*a* and 14*b*, which is remote from the corresponding coupler 13*a* or 13*b*, is supported by the opposed side wall 10*d* by means of a mounting piece 15*a* or 15*b* made of electrically insulating material such as polytetrafluoroethylene.

The microwave filter so far shown further comprises frequency tuning screws 16*a*, 16*b* and 16*c* which are helically adjustably extending through the top covering 10*a*, and terminate respectively adjacent the corresponding dielectric resonators 11*a* to 11*c*. As is well known to those skilled in the art, these tuning screws 16*a* to 16*c* are not always necessary where the microwave filter without such tuning screws is precisely constructed to meet a required performance characteristic.

Figure 3:
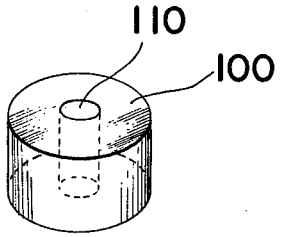
FIGS. 3 to 6 are perspective view, on an enlarged scale, of different types of dielectric resonators constructed in accordance with the teachings of the present invention.

With particular reference to FIG. 3, there is shown the details of any of the dielectric resonators 11*a*, 11*b* and 11*c* according to the present invention. The dielectric resonator is made of a cylindrical block 100 of any known dielectric material. The cylindrical block 100 has an aperture 100 of circular contour formed in said block 100 in alignment with the longitudinal axis thereof. The aperture 110 so far as the resonator of FIG. 3 is concerned is a through-hole extending completely through the thickness of the block 100. Alternatively, as shown in FIG. 5, the aperture 110 may extend in offset relation to the longitudinal axis of the block 100, the advantage of which will be described later.

Figure 4:
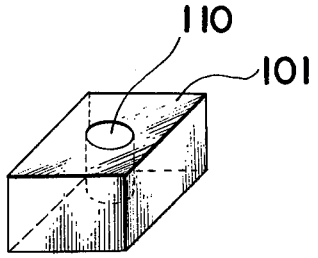

The block may, as indicated by 101 in FIG. 4, be a cubic body, in which case the aperture 110 may extend in the direction of thickness of said cubic block 101 through the geometrical center of said cubic body or in offset relation to said geometrical center of said cubic body.

Figure 5:
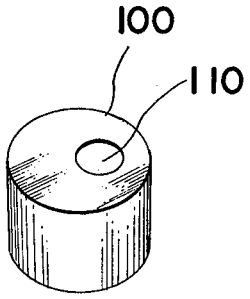
Figure 6:
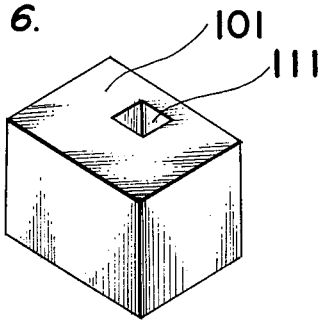

FIG. 6 illustrates the cubic block 101 having the aperture 111 of a contour similar to the shape of one four-cornered surface of said cubic block 101, which aperture 111 is shown as extending in offset relation to the geometrical center of the cubic body.

Where the microwave filter is constructed with the use of dielectric resonators of the construction shown in any of FIGS. 3 and 5, the dominant mode of resonance is $H_{01}$ and, on the other hand, where the microwave filter is constructed with the use of dielectric resonators of the construction shown in any of FIGS. 4 and 6, the dominant mode is $H_{11}$. Irrespective of the type of resonator, the mode approximating to the dominant mode $H_{01}$ or $H_{11}$ is $HE_{11}$. Under the $HE_{11}$ mode, the intensity of electric field at a position near the longitudinal axis of the dielectric resonator of the construction of any of FIGS. 3 and 5 and FIGS. 4 and 6 becomes maximum. On the other hand, under the dominant mode of $H_{01}$ or $H_{11}$, the intensity of electric field at a position near the longitudinal axis of the dielectric resonator of the construction of any of FIGS. 3 and 5 and FIGS. 4 and 6 becomes substantially zero.

Accordingly, the provision of the aperture 110 or 111 in the resonator has resulted in that variation of the resonance frequency of the dominant mode is very small, but a relatively great difference can be achieved between the maximum resonance frequency of the $HE_{11}$ mode and that of the dominant mode so that the spurious response characteristic can be improved. By way of example, the resonator made of a cylindrical block of dielectric material, 14.5 mm. in diameter and 6.7 mm. in thickness, having the aperture, 5.5 mm. in diameter, formed in alignment with the longitudinal axis of the dielectric block has exhibited that the resonance frequency at the dominant mode is 3,860 MHz and the resonance frequency at the mode approximating to the dominant mode is 6.120 MHz. On the other hand, the resonator of substantially the same size without the aperture has exhibited that the resonance frequency at the dominant mode is 3,820 MHz while that at the mode approximating to the dominant mode is 5,020 MHz.

From the foregoing comparison, it is clear that, although the resonance frequency at the dominant mode in the resonator with the aperture formed therein has shifted to 3,860 MHz as compared with that of 3,820 MHz at the dominant mode in the resonator without the aperture formed therein, there is a great difference in the resonance frequency at the mode approximating to the dominant mode between the resonator with the aperture and that without the aperture to an extent that the spurious response characteristic can remarkably be improved.

Figure 7:
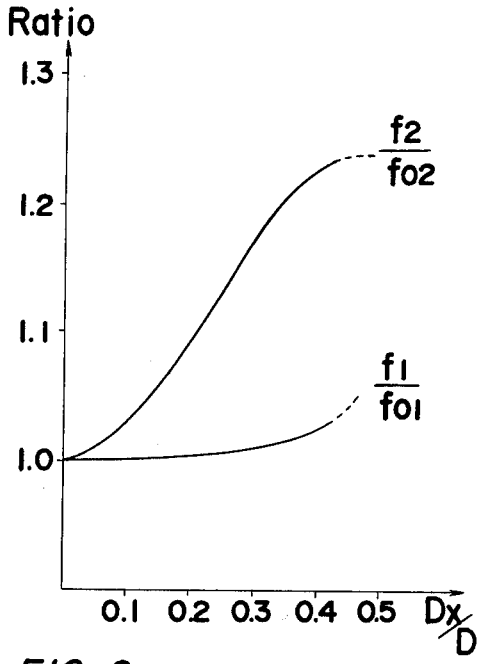
FIG. 7 is a graph illustrating performance characteristics of the dielectric resonator in relation to increase of the diameter of the aperture formed in the dielectric resonator.
Figure 8:
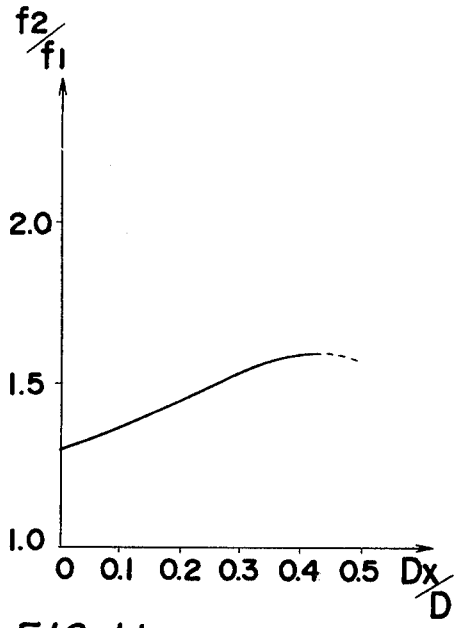
FIG. 8 is a graph illustrating a ratio of the resonance frequency of the dominant mode relative to the resonance frequency of a mode approximating to the high mode, with respect to a ratio of the outer diameter of the resonator relative to the diameter of the aperture formed in the resonator.

The advantage of the provision of the aperture in the dielectric resonator according to the present invention is clearly supported by the graph of FIG. 7, which illustrates a ratio of the resonance frequency $f_{01}$ at the dominant mode in the cylindrical resonator, D in diameter, without the aperture, relative to the resonance frequency $f_1$ at the dominant mode in the cylindrical resonator, D in diameter, with the aperture. It also exhibits a ratio of the resonance frequency $f_{02}$ at the mode approximating to the dominant mode in the cylindrical resonator, D in diameter, without the aperture, relative to the resonance frequency $f_2$ at the mode approximating to the dominant mode in the cylindrical resonator, D in diameter, with the aperture, both in relation to the increase of the diameter Dx of the aperture. On the other hand, FIG. 8 is a graph illustrating a ratio of the resonance frequency $f_1$ at the dominant mode relative to the resonance frequency $f_2$ which is achieved in the cylindrical dielectric resonator, D in diameter, in relation to the increase of the diameter Dx of the aperture formed in said dielectric resonator. These data, which have provided the basis for the graphs of FIGS. 7 and 8, were obtained by measurements conducted by the use of the dielectric resonator, having a dielectric constant $\epsilon$ of 36 and a value of 0.46 in the ratio of diameter to height, and subjected to $t/\lambda_0 \cong 0.24$, wherein $t$ represents the distance between metallic plate members positioned respectively adjacent upper and lower surfaces of the dielectric resonator and $\lambda_0$ represents the resonance wavelength at the dominant mode.

Hereinafter, the method of mounting each of the dielectric resonators 11*a* to 11*c* will be described with reference to FIGS. 9 to 11, and 13. However, it should be noted that, since all of the resonators 11*a* to 11*c* are mounted in the same manner, reference will be made to only one of them, for example, the resonator 11*a*, for the sake of brevity.

Figure 9:
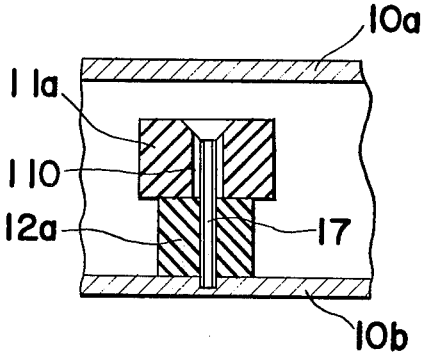
FIGS. 9 to 11, 13 and 15 illustrate various methods of mounting the dielectric resonator on one interior surface of the metal casing.

Referring first to FIG. 9, the resonator 11*a* is mounted on the bottom covering 10*b* of the casing 10 through the corresponding supporting spacer 12*a* and secured in position by a flat-headed bolt member 17 made of electrically insulating material, which bolt members 17 extends through the aperture 110 and then through the supporting spacer 12*a*, and is tapped into the bottom covering 10*b* with the flat-headed portion thereof partially seated in the aperture 110 so that the flat surface is flush with the uppermost surface of the resonator 11*a*.

Figure 11:
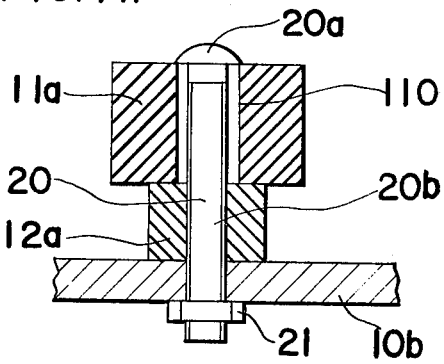
Figure 10:
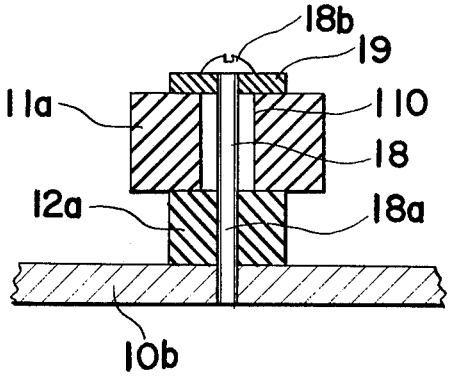

FIG. 10 illustrates an example wherein a mounting bolt member 18 is made of metallic material. Where the metallic bolt member 18 is employed in place of the electrically insulating bolt member 17 of FIG. 9, it is necessary to isolate the dielectric resonator 11*a* from the bolt member 18. For this purpose, in the example shown in FIG. 10, the bolt member 18 has a stud portion 18*a* having a diameter smaller than the diameter of the aperture 110 which is inserted through the aperture 110 in alignment with the longitudinal axis of said aperture 110, with a head portion 18*b* thereof seated on the uppermost surface of the resonator 11*a* through a spacer ring 19 made of electrically insulating material. One of the ends of the bolt member 18 opposed to the head portion 18*b* is tapped into the bottom covering 10*b*.

Where the bolt member is made of electrically insulating material, a method shown in FIG. 11 can be employed. In contrast to the method shown in FIG. 10, the method shown in FIG. 11 does not require the use of the spacer ring which has been necessitated in the method of FIG. 10 to isolate the resonator 11*a* from its contact to the bolt member 18 and, particularly, the head portion 18*b* thereof. However, the bolt member 20 used in the method of FIG. 11 is combined with a nut member 21. The use of the nut member 21 in connection with the bolt member 20 is recommended to ensure a steady and rigid mounting of the resonator 11*a* which will otherwise be achieved with no difficulty partly because of a limited thickness of the bottom covering 10*b* and partly because of the difference in the type of material between the bolt member 20 and the casing 10 including the bottom covering 10*b*. In other words, if the bolt member 20, made of electrically insulating material such as polytetrafluoroethylene or other synthetic resin, is otherwise tapped into the metallic bottom covering 10*b* such as practised in the method of FIG. 10, the resistance to impact and/or vibration will be lower than that achieved by the use of the nut member 21 used to fasten the bolt member 20 with the resonator 11*a*, spacer 12*a* and bottom covering 10*b* sandwiched between a head portion 20*a* and the nut member 21. A stud portion 20*b* of the bolt member 20 may have a diameter equal to or smaller than the diameter of the aperture 110 formed in the dielectric resonator 11*a*.

Figure 13:
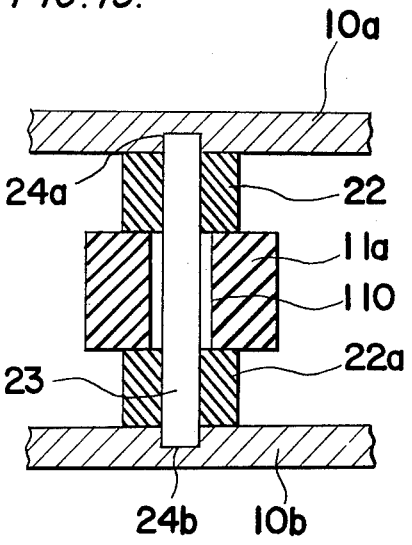

FIG. 13 illustrates a method wherein a mounting rod, made of either electrically insulating material or metallic material, is used to support the resonator 11*a*.

In the method of FIG. 13, while the resonator 11*a* is sandwiched between first and second supporting spacers 22*a* and 22*b* which may be prepared from the same material as used for the spacer 12*a*, the mounting rod 23 extends therethrough with both ends received in respective recesses 24*a* and 24*b* formed in the top and bottom coverings 10*a* and 10*b*. At this time, one or both of the spacers 22*a* and 22*b* serve as filler pads which fill respective spaces between the lower surface of the resonator 11*a* and the bottom covering 10*b* and between the upper surface of the resonator 11*a* and the top covering 10*a* and, therefore, at the time of completion of assembly of the microwave filter, the resonator 11*a* can firmly be held in position within the metallic casing 10. It is, however, to be noted that, if the rod 23 is made of metallic material, it should have a diameter smaller than the diameter of the aperture 110 in the resonator 11*a* and extend in alignment with the longitudinal axis of said aperture 110 in spaced relation to a cylindrical wall defining the aperture 110.

Figure 12:
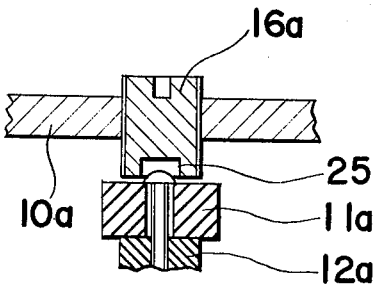
FIG. 12 illustrates a method of attaching a resonance frequency tuning member, which is applicable to the dielectric resonator mounted according to any of the methods shown in FIGS. 10, 11 and 15.

In describing the various methods of mounting the resonator 11*a* within the casing 10, no reference has yet been made to the associated tuning screw 16*a*. Even though the resonator 11*a* is mounted in the manner as shown in any of FIGS. 9 to 11, the tuning screw 16*a* can be employed. However, in the method of any of FIGS. 10 and 11, since the head portion 18*b* or 20*a* of the bolt member 18 or 20, respectively, outwardly projects from the resonator 11*a* towards the top covering 10*a*, the distance the tuning screw 16*a* can approach the associated resonator 11*a* is limited and, therefore, the frequency adjustment is limited. In order to avoid this, the tuning screw 16*a* may have an axially inwardly extending recess 25, as shown in FIG. 12, of a size sufficient to accommodate therein the head portion 18*b* or 20*a* of the bolt member 18 or 20 as the tuning screw 16*a* approaches the resonator 11*a*.

In the case where a tuning element functionally similar to the tuning screw 16*a* referred to above is to be applied to the mounting method of FIG. 13, a completely different arrangement is required. This is illustrated in FIG. 14, reference to which will now be made.

Figure 14:
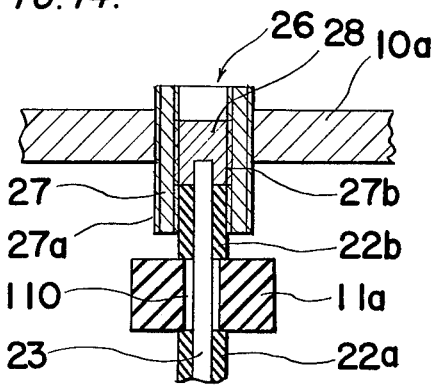
FIG. 14 illustrates another method of attaching the resonance frequency tuning member, which is applicable to the resonator mounted according to the method shown in FIG. 13.

In FIG. 14, the frequency tuning element, generally indicated by 26, comprises a sleeve 27 having a threaded outer peripheral surface 27*a*, adjustably engaged in a correspondingly threaded hole formed in the top covering 10*a*, and a threaded inner surface 27*b* adjustably receiving therein an externally threaded boss member 27 ridigly mounted on one end of the rod 23 in contact with the second spacer 22*b*. The other end of the rod 23 is to be understood as pressure-fitted, or otherwise secured by the use of a bonding agent, into the corresponding recess 24*b* (FIG. 13) in the bottom covering 10*b*.

In the arrangement of FIG. 14, it will readily be seen that, by turning the sleeve 27 in either direction about the longitudinal axis thereof, one of the opposed annular ends of said sleeve 27 can be moved towards and away from the adjacent surface of the resonator 11*a* without any accompanying axial movement of the boss member 28 and, therefore, the resonator 11*a*.

In practice, irrespective of the methods of mounting the resonator 11*a* on the bottom covering 10*b*, the use of a bonding agent is preferred to ensure a rigid connection of the dielectric resonator 11*a* to the spacer 12*a* or the spacers 22*a* and 22*b*. The bonding agent may be $\alpha$-cyano acrylate.

Where the resonators 11*a* to 11*c* are of the construction such as shown in any of FIGS. 5 and 6, the degree of coupling of these resonators can readily and easily be carried out. This is because the position of the longitudinal axis of the aperture 110 or 111 shown in FIG. 5 or 6 is in offset or eccentrical relation to the geometrical center of the shape of one surface of the resonator block 100 or 101. More specifically, by turning any of the resonators 11*a* to 11*c* about the mounting member such as indicated by 17 in FIG. 9, 18 in FIG. 10, 20 in FIG. 11 or 23 in FIG. 13, the distance between the adjacent two of these resonators 11*a* to 11*c* can be adjustable and, therefore, the degree of coupling can be adjustable. Once the desired degree of coupling is attained, these resonators 11*a* to 11*c* may be held in position within the filter casing 10.

Even though the resonator block 100 or 101 shown in FIG. 3 or 4 is employed for the dielectric resonators 11*a* to 11*c*, a similar adjustment as to the degree of coupling can be performed with or without coupling screws, which will now be described with reference to each of FIGS. 15 and 16.

Figure 15:
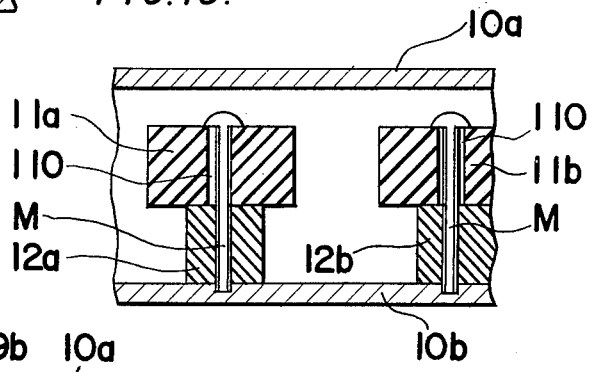

In FIG. 15, only two of the resonators 11*a* and 11*b* are illustrated. Each of the resonators 11*a* and 11*b* is, in the instance as shown, of the construction shown in FIG. 3 and is mounted on the bottom covering 10*b* through the spacer 12*a* or 12*b*, while a mounting member M extends through the aperture 110 and then through the corresponding spacer 12*a* or 12*b* and is subsequent tapped into the bottom covering 10*b*. It is to be noted that the mounting member M may be the bolt member 18 of FIG. 10 and 20 of FIG. 11 or the rod 23 of FIG. 13, but should be understood as having a diameter smaller than the diameter of the aperture 110.

As clearly illustrated in FIG. 15, depending upon the position of the longitudinal axis of the mounting member M, which extends through the dielectric resonator 11*a* or 11*b*, relative to the longitudinal axis of the aperture 110, the minimum distance between the adjacent two resonators 11*a* and 11*b* can be varied. In this way, the degree of coupling of the resonators can be adjusted during the manufacturing process and prior to the top covering 10*a* being rigidly secured on the top edges of the walls 10*c* to 10*f* (FIG. 1).

Figure 16:
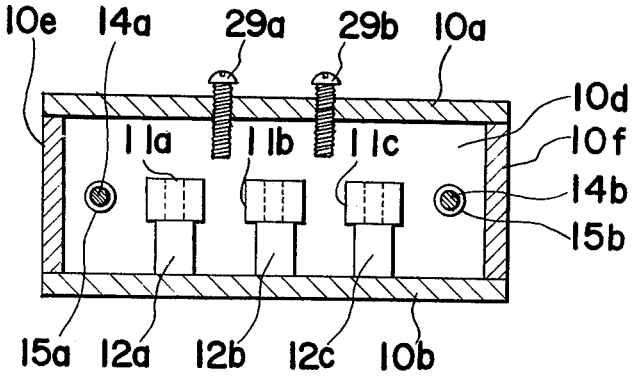
FIG. 16 is a view similar to FIG. 2, illustrating the microwave filter according to a second preferred embodiment of the present invention.

In the embodiment shown in FIG. 16, coupling screws 29*a* and 29*b* are employed. These coupling screws 29*a* and 29*b* are adjustably extend through the top covering 10*a* in spaced relation to each other, in such a manner that the longitudinal axis of the coupling screw 29*a* extends intermediately between the resonators 11*a* and 11*b* and that of the other coupling screw 29*b* extends intermediately between the resonators 11*b* and 11*c*.

The microwave filter according to the embodiment of FIG. 16 is designed so that, by the adjustment of the coupling screws 29*a* and 29*b*, the degree of coupling at the $H_{01}$ mode can be varied while undesirable or unnecessary modes such as $HE_{11}$ mode can be suppressed.

Figure 17:
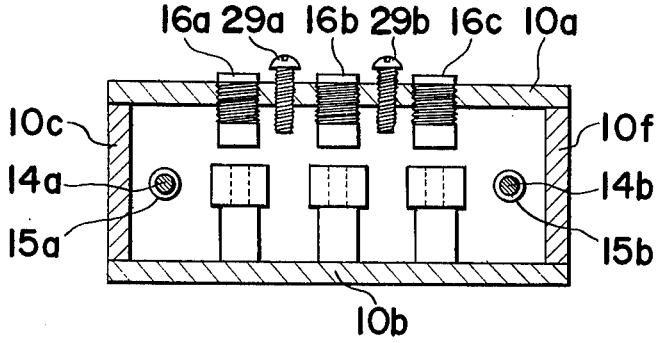
FIG. 17 is a view similar to FIG. 2, illustrating the microwave filter according to a third preferred embodiment of the present invention.

The coupling screws 29*a* and 29*b* may be used together with the frequency tuning screws 16*a* to 16*c* as shown in FIG. 17.

Figure 18:
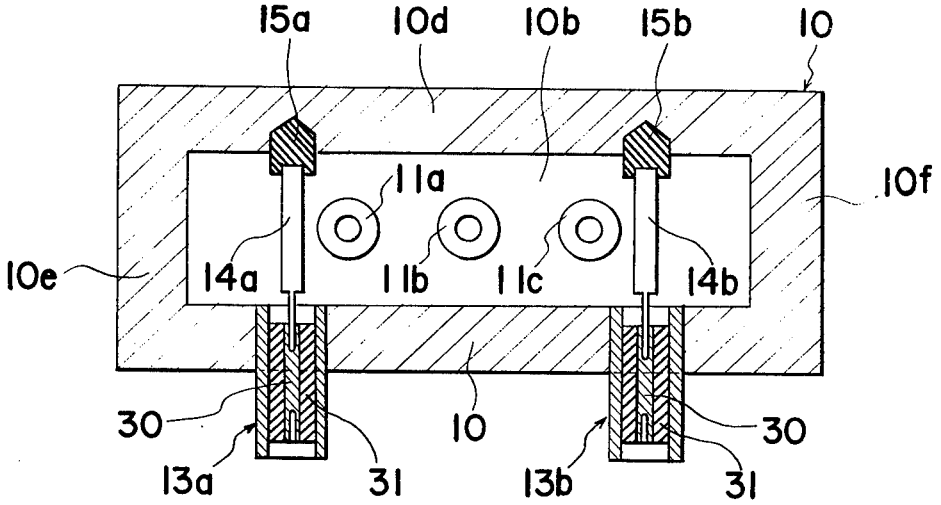
FIG. 18 is a top sectional view of the microwave filter, illustrating a method of connecting probes to respective couplers adapted to receive coaxial cables for input and output microwave lines.

FIG. 18 illustrates a manner of connection between the coaxial couplers 13*a* and 13*b* and the associated probes 14*a* and 14*b*.

With particular reference to FIG. 18, the input coupler 13*a* is in the form of a sleeve having one end portion pressure-fitted, or otherwise firmly tapped, into the side wall 10*c* in electrically conductive relation with respect to the filter casing 10, and the other end portion is exposed to the outside of the casing 10 for connection with a coaxial cable. The coupler sleeve 13*a* has a hollow portion in which a central electrode 30 is firmly accommodated through a spacer sleeve 31 made of electrically insulating material. The associated probe 14*a* has one end reduced in diameter and firmly inserted into the central electrode 30 in alignment with the longitudinal axis of said electrode 30.

The output coupler 13*b* is of the same construction as the input coupler 13*a* and, therefore, the description thereof is herein omitted for the sake of brevity.

Figure 19:
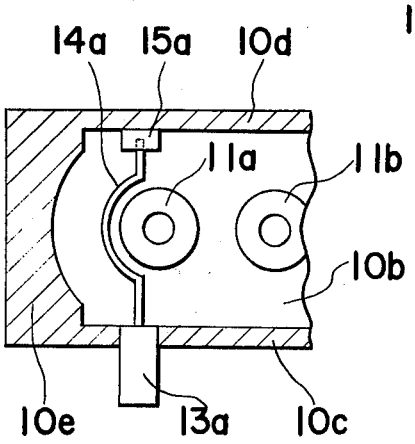
FIG. 19 is a top sectional view of a portion of the microwave filter, illustrating one of modified probes employed therein.

While each of the input and output probes 14*a* and 14*b* so far described is in the form of a straight rod, a substantially intermediate portion of any of the probes may be outwardly curved in complementary relation to the sectional contour of the end resonator 11*a* or 11*c* as shown in FIG. 19. In addition, the inner surface of the wall 10*e* or 10*f* adjacent the associated curved portion of any of the probes 14*a* and 14*b* is preferably inwardly rounded to accomodate that curved portion of the probe in equally spaced relation to each other.

Figure 20:
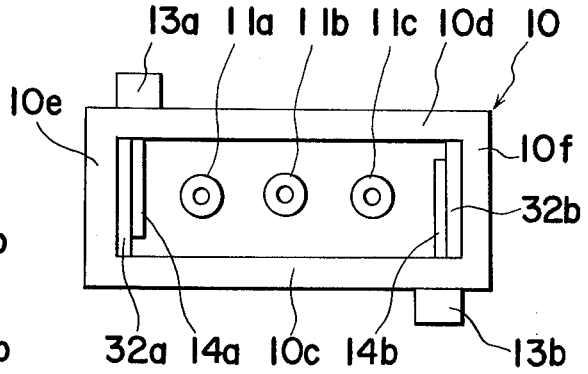
FIGS. 20(*a*) and (*b*) are top plan view and side sectional view, respectively, of the microwave filter, illustrating a method of mounting the probes within the metal casing.
Figure 20:
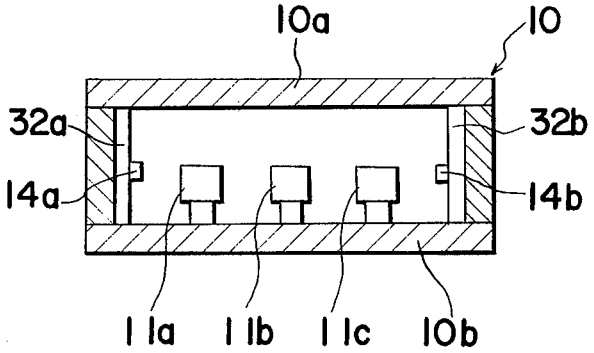
Figure 21:
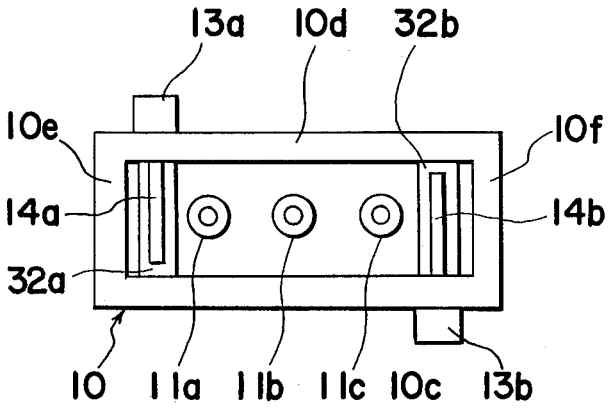
FIGS. 21(*a*) and (*b*) are top plan view and side sectional view, respectively, of the microwave filter, illustrating another method of mounting the probes within the metal casing.

Instead of the ends of the probes 14*a* and 14*b* adjacent the wall 10*d* being respectively supported by said wall 10*d* by means of the associated mounting pieces 15*a* and 15*b* , the probes 14*a* and 14*b* may terminate adjacent the wall 10*d* and be secured to corresponding spacer bars 32*a* and 32*b*, which are in turn secured to the inner surfaces of the walls 10*e* and 10*f* as shown in FIGS. 20 (*a* ) and (*b* ) or to the inner surface of the bottom covering 10*b* as shown in FIGS. 21(*a* ) and (*b* ). It is to be noted that, in any of FIGS. 20(*a* ) and (*b* ) and 21(*a* ) and (*b* ), the input and output couplers 13*a* and 13*b* are shown as respectively provided in the walls 10*d* and 10*c*. This does not result in reduction of the performance of the resultant microwave filter.

In the arrangement of any of FIGS. 20(*a* ) and (*b* ) and FIGS. 21(*a* ) and (*b* ), the spacer bars 32*a* and 32*b*, made of electrically insulating material, serve as striplines.

Figure 25:
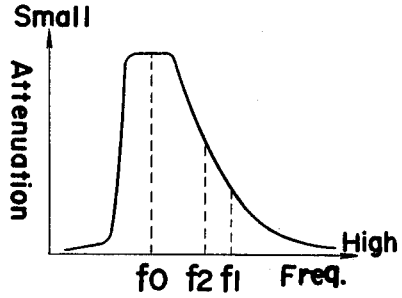
FIG. 25 is a graph illustrating a characteristic curve of the resonance frequency in relation to the attenuation, which is achieved by the microwave filter of FIG. 1.

In the foregoing various embodiments of the present invention, the resonators 11*a* to 11*c* have been described as arranged in a row extending between the end walls 10*e* and 10*f* of the filter casing 10. It has been found that, in such microwave filters, as shown in the graph of FIG. 25, the amount of attenuation of frequencies higher than the center frequency $f_0$ tends to slowly increase as indicated by a portion A of the curve in the graph of FIG. 25. In order to avoid this, various methods can be contemplated. One method is to increase the number of dielectric resonators to be used within the filter casing, but would result in increase of the overall size of the resultant filter as well as the manufacturing cost.

According to the present invention, in order to make it possible to manufacture the bandpass filter in a minimum size and also to minimize the possible insertion loss, an additional resonator 33 in the form of a ring resonator is utilized. The position of the ring resonator 33 may be selected as desired. However, in the embodiment shown in FIG. 22, the intermediate resonator 11*b* and the ring resonator 33 are positioned on respective sides with respect to the center line passing through the end resonators 11*a* and 11*b* . The ring resonator 33 is selected so as to have a resonance frequency $f_1$ which is higher than the center frequency $f_0$.

Figure 23:
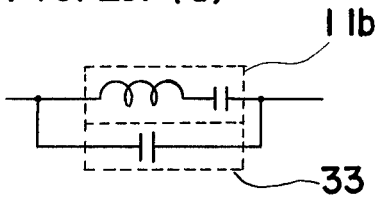
FIGS. 23(*a*) to (*c*) illustrate equivalent circuits of the microwave filter shown in FIG. 22.
Figure 23:
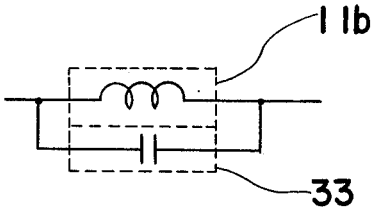
Figure 23:
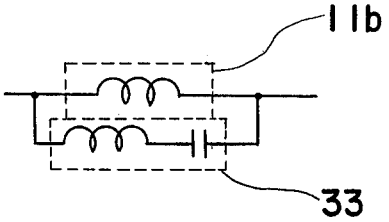

Accordingly, with respect to a microwave signal having the center frequency $f_0$, a combination of the intermediate resonator 11*b* and the ring resonator 33 constitutes such an equivalent circuit as shown in FIG. 23(*a* ). From the circuit of FIG. 23(*a* ), it is clear that the ring resonator 33 exhibits a property of capacitance.

Figure 26:
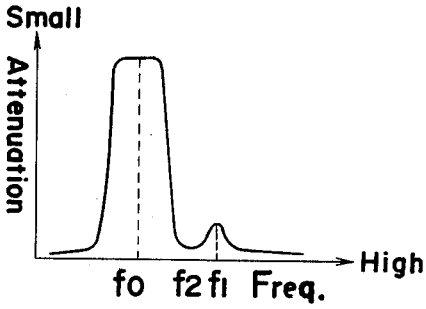
FIG. 26 is a graph illustrating a characteristic curve of the resonance frequency in relation to the attenuation, which is achieved by the microwave filter of FIGS. 22 and 24.

With respect to a microwave signal having a frequency higher than the center frequency $f_0$ of the filter and lower than the resonance frequency $f_1$ of the ring resonator 33, it is clear from the equivalent circuit of FIG. 23(*b* ) that the resonator 11*b* exhibits a property of electroconductance while the ring resonator 33 exhibits a property of capacitance. Therefore, anti-resonance occurs within the range from the center frequency $f_0$ to the frequency higher than the center frequency but lower that the resonance frequency $f_1$ so that, as shown in the graph of FIG. 26, the amount of attenuation of frequencies higher than the center frequency rapidly becomes high representing a steep curve. In other words, the shape factor can be improved.

With respect to a microwave signal having a frequency equal to the resonance frequency $f_1$ of the ring resonator 33, it is clear from the equivalent circuit shown in FIG. 23(*c* ) that the resonator 11*b* exhibits a property of electroconductance. Although a spurious response will occur, as indicated by B in the graph of FIG. 26, in relation to the signal having the frequency equal to the resonance frequency $f_1$, it can be neglected if the ring resonator 33 is damped with respect to Q.

Figure 24:
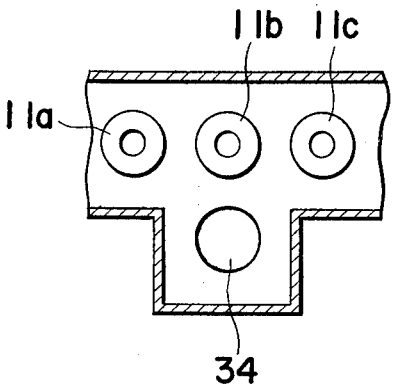
FIG. 24 is a top sectional view of a portion of the microwave filter according to a fifth preferred embodiment of the present invention.

In the embodiment shown in FIG. 24, there is illustrated an example wherein a conventional dielectric resonator 34 is additionally employed and positioned on one side of the row of the resonators 11*a* to 11*c* and adjacent the intermediate resonator 11*b*, while the wall 10*c* of the casing 10 is modified to accommodate the additional resonator 34. With respect to the performance, even the arrangement of FIG. 24 is substantially similar to that shown in FIG. 22.

Figure 22:
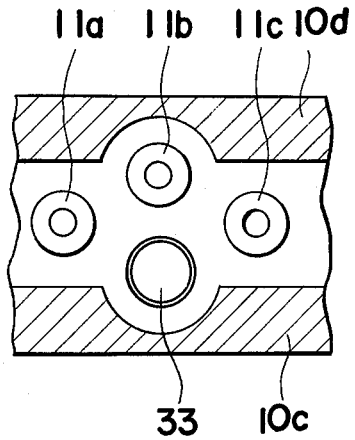
FIG. 22 is a top sectional view of a portion of the microwave filter according to a fourth preferred embodiment of the present invention.
Figure 21:
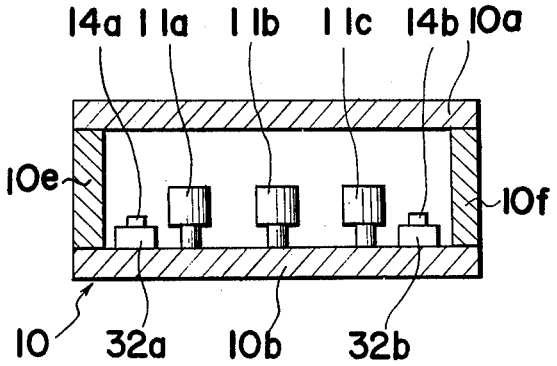

It is to be noted that the ring resonator 33 employed in the embodiment of FIG. 22 may be replaced by either a conventional dielectric resonator or a resonator of the construction shown in any of FIGS. 3 to 6. A similar description made above may equally be applicable to the resonator 34 employed in the embodiment of FIG. 24. Moreover, the number of additional resonators is not limited to one such as shown in any of FIGS. 22 and 24, but may be two or more.

Furthermore, the number of the dielectric resonators to be contained in the filter casing 10 is not limited to three, but may be one, two or more than three depending upon the desired design of the microwave filter. In addition, the number of the apertures may not be limited to one, but may be two or more. In the case where one dielectric resonator is formed with a plurality of apertures, these aperture may be of the same or different size and may be through-holes or cavities or a combination thereof.

The dielectric resonators 11*a* to 11*c* so far illustrated may be of the same size or of different size with respect to each other.

It is to be noted that, in the microwave filter employing two or more dielectric resonators having the respective apertures of different size while the size of the dielectric resonators is selected such that the center frequency of one dielectric resonator is equal to that of the remaining dielectric resonator, the spurious frequencies peculiar to these resonators can advantageously be separated and, therefore, the overall spurious response characteristic of the microwave filter can be improved.

The embodiment shown in FIGS. 27 to 30 illustrates an example of microwave filter which can readily be installed on a microwave integrated circuit substrate without the use of any coaxial transmission cables.

Figure 27:
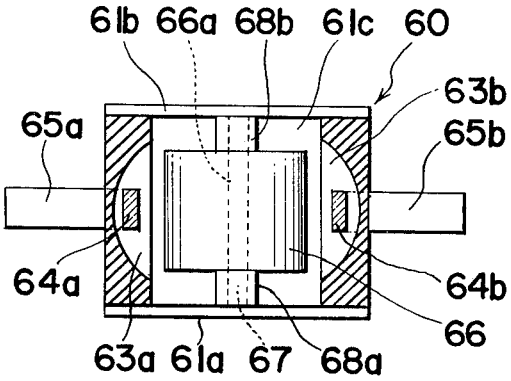
FIG. 27 is a top plan view of the microwave filter according to a sixth preferred embodiment of the present invention, which is shown with a covering removed.
Figure 28:
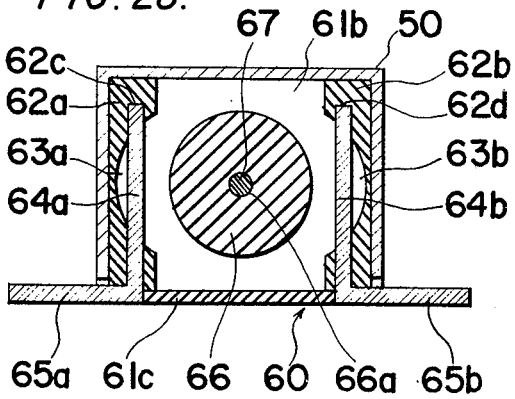
FIG. 28 is a side sectional view of the microwave filter shown in FIG. 27.
Figure 29:
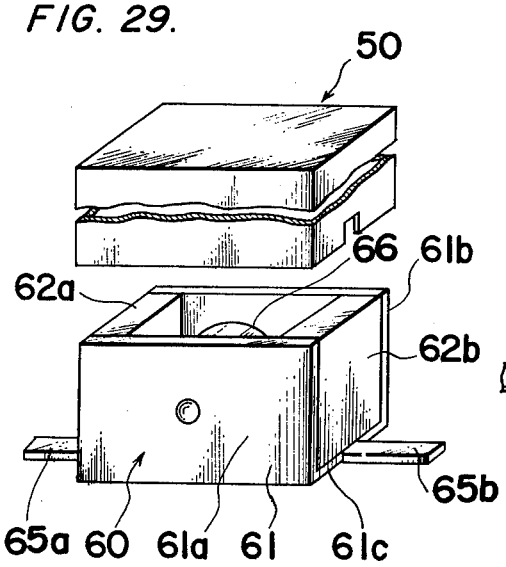
FIG. 29 is a schematic perspective view of the microwave filter shown in FIG. 28.

Referring particularly to FIGS. 27 to 29, a microwave filter casing comprises a substantially box-like shielding cover 50 and a container 60 adapted to be covered by the shielding cover 50. The container 60 comprises a substantially U-sectioned body 61 having a pair of opposed walls 61*a* and 61*b* and a bottom wall 61*c*, and a pair of end walls 62*a* and 62*b*. The end walls 62*a* and 62*b* have a width substantially equal to the interior space between the walls 61*a* and 61*b* and are held in position on respective ends of the U-sectioned body 61, so that all the elements 61*a* to 61*c* and 62*a* and 62*b* cooperate to provide the container 60 of a shape similar to a top-opened box.

The container 60, including the body 61 and the end walls 62*a* and 62*b*, is made of electrically insulating material such as polytetrafluoroethylene or any other suitable synthetic resin.

As best shown in FIGS. 27 and 28, each of the end walls 62*a* and 62*b* has a interior surface inwardly rounded, or otherwise recessed, to provide a cavity 63*a* and 63*b* for minimizing the insertion loss which may otherwise occur in association with a corresponding oscillating probe 64*a* and 64*b*. The probes 64*a* and 64*b* extend at right angles to the plane of the bottom wall 61*c* and intermediately of the width of the end walls 62*a* and 62*b*, and have one end received by respective portions 62*c* and 62*d* of the end walls 62*a* '*and 62b* and the other end extending through respective portions opposed to the portions 62*c* and 62*d* of the end walls 62*a* and 62*b*, respectively. Said respective other ends of the probes 64*a* and 64*b* are in turn connected, or otherwise integrally formed, with input and terminal members 65*a* and 65*b* which extend in parallel relation to the plane of and flush with the bottom wall 61*c*. A substantially intermediate portion of each of the probes 64*a* and 64*b* bridges over the corresponding cavity 63*a* and 63*b*.

Within the container 60 of the above construction, there is accommodated a dielectric resonator 66 of the shape as shown in FIG. 3 having an aperture 66*a* extending in alignment with the longitudinal axis of the resonator 66. This dielectric resonator 66 is mounted on a supporting rod 67 made of synthetic resinous material, having both ends secured to, or otherwise rigidly inserted into, the walls 61*a* and 61*b*. Mounted on the supporting rod 67 between the wall 61*a* and the resonator 66 and between the wall 61*b* and the resonator 66 are spacer sleeves 68*a* and 68*b*, made of electrically insulating material such as alumina, for holding the dielectric resonator 66 in position intermediately of the length of the rod 67 and on said rod 67.

Figure 30:
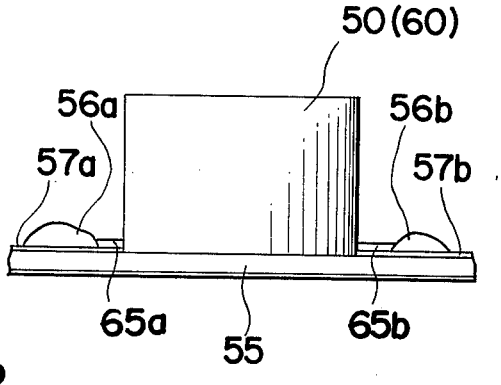
FIG. 30 illustrates a method of connecting the microwave filter of FIGS. 27 to 29 to a microwave integrated circuit substrate.

A complete microwave filter can be assembled by covering the shielding cover 50 over the container 61, substantially as shown in FIG. 30. This complete microwave filter is, as shown in FIG. 30, placed on a microwave integrated circuit substrate 55 with the terminal members 65*a* and 65*b* held flat against and subsequently soldered, as at 56*a* and 56*b*, to respective printed wirings 57*a* and 57*b* on one surface of the substrate 55 to which they are to be electrically connected.

It is to be noted that the aperture 66*a* in the dielectric resonator 66 may have a diameter greater than the diameter of the supporting rod 67, in which case both end faces of the resonator 66 are preferably bonded to the associated spacer sleeves 68*a* and 68*b* thereby preventing the resonator 66 from contacting the rod 67.

While in the embodiments described above except for that shown in FIGS. 27 to 30 the frequency adjusting or tuning means have been described as comprised of one or more tuning screws, such as indicated by 16*a* to 16*c*, or a sleeve such as indicated by 26, a quite different arrangement of the tuning means is employed in the embodiment which will now be described with reference to FIG. 31.

Figure 31:
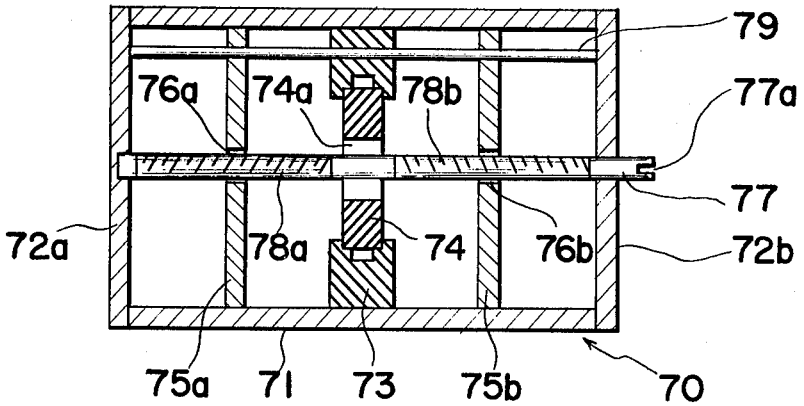
FIG. 31 is a top sectional view of the microwave filter according to a seventh preferred embodiment of the present invention.

A microwave filter shown in FIG. 31 comprises a shielded metallic casing 70 including a hollow body 71 of any desired sectional shape, and a pair of opposed lids 72*a* and 72*b* closing the respective openings at the opposed ends of the hollow body 71. Positioned intermediately of the length of the hollow body 70 within the hollow body 70 is a carrier 73, made of electrically insulating material, which carries a dielectric resonator 74 in position within the hollow body 71. The dielectric resonator 74 has an aperture 74*a* in the form of a through-hole extending in a lengthwise direction of the hollow body 71.

The carrier 73 may be made of a single piece of electrically insulating material having an outer contour similar to the cross sectional shape of the hollow body 71 or separate pieces of electrically insulating material. If the carrier 73 is made of separate pieces, they are secured to the inner surface of the hollow body 71 in spaced relation to each other.

Within the filter casing 70, a pair of frequency adjusting plate members 75*a* and 75*b* are provided on respective sides of the dielectric resonator 74. These plate members 75*a* and 75*b* are respectively formed with threaded holes 76*a* and 76*b* both in alignment with the aperture 74*a* in the dielectric resonator 74 carried in position within the hollow body 71.

Extending through the holes 76*a* and 76*b* in the plate members 75*a* and 75*b* and the aperture 74*a* in the dielectric resonator 74*a*, is a tuning rod 77 having one end journalled to the lid 72*a* and the other end rotatably extending through the other lid 72*b* and formed into a tuning knob as indicated by 77*a*. This tuning rod is threaded at portions between the lid 72*a* and the resonator 74 and between the resonator 74 and the lid 72*b*, respectively, as indicated by 78*a* and 78*b*. Respective threads on the portions 78*a* and 78*b* of the tuning rod 77 extend in opposite relation to each other around the tuning rod 77, so that the adjustment of the tuning rod 77 in either direction about the longitudinal axis thereof results in the plate members 75*a* and 75*b* simultaneously moving in a direction close to and away from each other with the resonator 74 stationarily positioned therebetween.

In order to avoid any possible fluttering of any of the plate members 75*a* and 75*b* which may otherwise occur during simultaneous movement of said members 75*a* and 75*b*, one or more guide rods, only one of which is shown by 79 in FIG. 31, may be employed. In the instance as shown, the guide rod 79 has both ends secured to the lids 72*a* and 72*b*, a substantially intermediate portion thereof slidably extending through the plate member 75*a*, then the carrier 73 and finally the plate member 75*b*.

Figure 32:
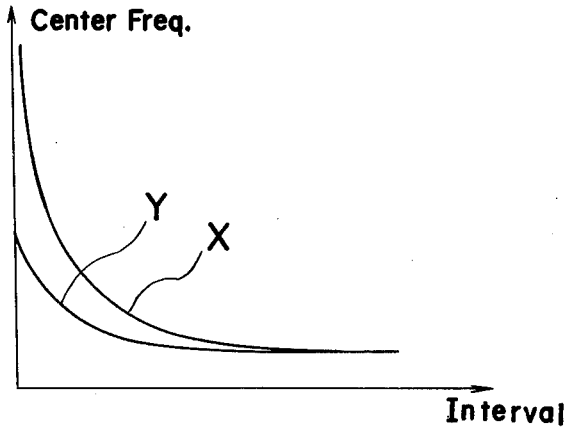
FIG. 32 is a graph illustrating the performance characteristic of the microwave filter shown in FIG. 31.

The microwave filter of the construction shown in FIG. 31 exhibits a performance curve indicated by X in the graph of FIG. 32. Also shown in this graph of FIG. 32 is a performance curve Y exhibited by a microwave filter of a construction similar to that shown in FIGS. 1 and 2, but having one dielectric resonator without aperture formed therein, and also having a frequency tuning means in the form of a screw, which microwave filter exhibiting the performance curve Y is now commercially available.

In the graph of FIG. 26, the terms "interval"represented by the axis of abscissas is intended to mean the distance between the plate members 75*a* and 75*b* in the case of the present invention, and the distance between the end of the tuning screw adjacent the resonator and the latter in the case of the conventional microwave filter. From the comparison of these performance curves X and Y, it will readily be seen that, with the microwave filter of the construction shown in FIG. 31, a relatively wide range of center frequencies can be adjustable with minimum reduction of the Q value.

Although the present invention has been fully described by way of example in connection with the various embodiments thereof, it should be noted that various changes and modifications are apparent to those skilled in the art. By way of example, the resonator according to the present invention can be used not only in the microwave bandpass filter referred to above, but also in any other microwave filters such as microstrip filters and waveguide filters. In addition, even in the embodiment shown in any of FIGS. 27 to 30 and 31, the dielectric resonator may have one or more additional apertures other than the aperture such as indicated by 66*a* in FIGS. 27 to 29 and 74*a* in FIG. 31.

Therefore, these changes and modifications are to be understood as included within the scope of the present invention unless they depart therefrom.

What is claimed is:

1. A dielectric resonator which comprises a block of dielectric material and at least one aperture formed in said block, said aperture having a diameter selected to be within such a range that a substantial increase in frequency at a spurious mode having a spurious frequency adjacent a frequency at the dominant mode takes place relative to that attained by said dielectric block without said aperture, said diameter range also being such that an increase in frequency at the dominant mode relative to that attained by said dielectric block without said aperture takes place to a negligible extent, the ratio of the spurious frequency attained in the apertured dielectric resonator to that attained by the frequency at the dominant mode in said resonator being greater than about 1.3.

2. A dielectric resonator as claimed in claim 1, wherein said block is of a cylindrical shape and said aperture extends in alignment with the longitudinal axis of said cylindrical block.

3. A dielectric resonator as claimed in claim 1, wherein said block is of a cylindrical shape and said aperture extends in offset relation to the longitudinal axis of said cylindrical block.

4. A microwave filter which comprises in combination:

an electrically shielded casing;

input and output terminal members extending from the outside of said casing into the interior of said casing, portions of said input and output terminal members within said interior of said casing being opposed to each other;

at least one dielectric resonator having at least one aperture formed therein, said dielectric resonator being positioned within said casing and between said portions of said terminal members in electrically insulated relation to said casing and in spaced relation to any of said portions of said input and output terminal members;

said aperture having a diameter selected to be within such a range that substantial increase in frequency at a spurious mode having a frequency adjacent a frequency at the dominant mode takes place relative to that attained by said dielectric block without said aperture, said diameter range also being such that an increase in frequency at the dominant mode relative to that attained by said dielectric block without said aperture takes place to a negligible extent, the ratio of the spurious frequency attained in the apertured dielectric resonator to that attained by the frequency at the dominant mode in said resonator being greater than about 1.3.

5. A microwave filter as claimed in claim 4, further comprising means for tuning the filter characteristic of the dielectric resonator.

6. A microwave filter as claimed in claim 4, including a plurality of the dielectric resonators disposed within the casing in spaced relation to each other.

7. A microwave filter as claimed in claim 6, further comprising means for tuning the filter characteristic of each of the dielectric resonators.

8. In a microwave filter comprising an electrically shielded casing, input and output terminal members extending from the outside of said casing into the interior of said casing, portions of said input and output terminal members within said interior of said casing being opposed to each other, at least one dielectric resonator disposed within said casing and between said portions of said terminal members in electrically insulated relation to said casing and in spaced relation to any of said input and output terminal members, the improvement wherein said dielectric resonator comprises at least one aperture formed therein, said aperture having a diameter selected to be within such a range that a substantial increase in frequency at a spurious mode having a frequency adjacent a frequency at the dominant mode takes place relative to that attained by said dielectric block without said aperture, said diameter range also being such that an increase in frequency at the dominant mode relative to that attained by said dielectric block without said aperture takes place to a negligible extent, the ratio of the spurious frequency attained in the apertured dielectric resonator to that attained by the frequency at the dominant mode in said resonator being greater than about 1.3.

9. A microwave filter which comprises in combination:

a hollow waveguide having input and output openings opposed to each other, said waveguide being disposed on a microwave transmission line; and at least one dielectric resonator having at least one aperture formed therein, said dielectric resonator being positioned within said waveguide and between said input and output openings in electrically insulated relation to said waveguide;

said aperture having a diameter selected to be within such a range that a substantial increase in frequency at a spurious mode having a frequency adjacent a frequency at the dominant mode takes place relative to that attained by said dielectric block without said aperture, said diameter range also being such that an increase in frequency at the dominant mode relative to that attained by said dielectric block without said aperture takes place to a negligible extent, the ratio of the spurious frequency attained in the apertured dielectric resonator to that attained by the frequency at the dominant mode in said resonator being greater than about 1.3.

* * * * *